United States Patent [19]

Criblez et al.

[11] Patent Number: 4,488,420

[45] Date of Patent: Dec. 18, 1984

[54] PROCESS AND APPLIANCE FOR FEEDING MATERIAL TO HOT AND SEMI-COLD METAL-WORKING MACHINES

[75] Inventors: Roger Criblez, Bottmingen, Switzerland; Raymond Schoenenberger, Rosenau, France

[73] Assignee: Hatebur Umformmaschinen AG, Reinach, Switzerland

[21] Appl. No.: 400,847

[22] Filed: Jul. 22, 1982

[30] Foreign Application Priority Data

Aug. 14, 1981 [CH] Switzerland ..... 5270/81

[51] Int. Cl.[3] ..... B21K 29/00

[52] U.S. Cl. ..... 72/128

[58] Field of Search ..... 72/128, 129, 130, 131; 226/154, 155

[56] References Cited

U.S. PATENT DOCUMENTS 3,820,367 6/1974 Kline ..... 72/128

4,040,553 8/1977 Götz ..... 226/154

4,404,830 9/1983 Koch ..... 72/128

*Primary Examiner*—E. M. Combs

*Assistant Examiner*—Charles Rosenberg

*Attorney, Agent, or Firm*—Ladas & Parry

[57] ABSTRACT

A device for feeding material in the form of a coil of wire from a fixture for receiving and rotating said coil of wire through a straightening apparatus and a heating station to a hot and semi-cold metal-working machine in an intermittent manner. The device includes a cold feeding fixture with one or more pair of rollers which act on the cold wire to pull the wire from the coil and through the straightening apparatus and a hot feeding fixture downstream of the heating station with at least one pair of feed rollers which act on the hot wire and urge the hot wire against a stop of the metal-working machine. The device also includes adjustable link means for driving both feeding fixtures in formulant synchronism with the metal-working machine.

11 Claims, 5 Drawing Figures

PROCESS AND APPLIANCE FOR FEEDING MATERIAL TO HOT AND SEMI-COLD METAL-WORKING MACHINES

The invention relates to a process for feeding material to hot and semi-cold metal-working machines in metal-working which does not involve cutting, in which process a material, available in the form of a coil of wire, is straightened in a straightening apparatus and is fed forward, in an intermittent manner, against a stop, by means of at least one feed device comprising one or more pairs of feed rollers, is heated, is divided into individual lengths, and is fed to the hot metal-working machine.

The invention additionally relates to an appliance for carrying out this process, with a fixture for receiving and rotating the coil of wire, a straightening apparatus, located downstream of the abovementioned fixture, a device for feeding the wire forward, in an intermittent manner, and at least one heating station.

In conventional hot metal-working machines, the feed material is in the form of rod, which passes through a heating station during this feeding process, where it is heated to a temperature slightly below its melting point. Immediately afterwards, it is gripped by a feed device belonging to the metal-working machine, and this feed device now guides the material, in an intermittent manner, matched to the rotation speed of the machine, into a shearing-off device, which produces sections of identical lengths, which are then further processed in the machine, that is to say, are worked to shape. It is obvious that efforts are made to heat the material, which is to be worked, to a temperature which is as high as possible, so that the work required to deform it can be kept as small as possible. This requirement entails, in turn, the need to avoid subjecting the heated starting material to any high stresses, particularly tensile stresses, since it is desirable to avoid plastic deformation of the material. For this reason, in hot-working, straight rods are used as starting material, these rods being several meters long. These, however, have the disadvantage that, at each transition from one rod to the next, some offcuts have to be discarded, in order to obtain sheared-off sections which always have the same volume. In consequence of this, a comparatively large amount of waste occurs in this process. In order to keep this waste as small as possible, the transitions between successive rods must be drastically reduced in number, that is to say, it should be possible, in the ideal case, to use an "endless rod". Such "endless rods", that is to say, rods having a considerable length, are, however, available in the form of coils of wire.

The use of coils of wire for hot-working has, up to the present, run into major problems, which could not be solved by means of the known feed devices. In the course of the metal-working process, which takes place at a high repetition rate, the material, in rod form, is of course repeatedly pushed against a fixed stop, at the operating frequency of the machine. In order to be certain of ensuring that the front end of the rod encounters the stop, a slight thrust should still be exerted on the rod at the moment it encounters the stop, and this, obviously, is possible only if the feed rollers can slide on the surface of the rod as soon as it comes to a standstill.

In contrast to the hot-feeding fixture, the contact pressure of the feed rollers on the cold-feeding fixture is much higher (several tons, for example). The known cold-feeding devices cannot accordingly be used for hot-feeding, since very much less force is required to deform the hot rod material than occurs when the rollers slide and rub against the surface of the rod, which would accordingly always bend shortly after encountering the stop.

Moreover, the known hot-feeding device, which operates with a considerably lower contact pressure, would also be in no way suitable for hot-feeding material in the form of coiled wire. The known hot-feeding device cannot produce the tensile force required for pulling off the wire and passing it through the straightening apparatus, while an appropriate increase in the contact pressure, and hence in the tensile force, would in turn lead to deformation of the heated wire.

The problem of automatically feeding material in the form of coiled wire, in an intermittent manner, for the purpose of hot-working, could not, as a consequence of the problems described, be solved in a satisfactory manner up to the present time.

Admittedly, German Offenlegungsschrift No. 2,450,422 shows a machine which can be used for hot-working, which operates from a coil of wire. In this machine, the wire is pulled from the coil by means of a driving element, and is forced through a first straightening apparatus, which straightens it to the extent that it forms a loop. A sensor is installed inside this loop, this sensor transmitting commands to the drive element, which, on its own account, runs at a constant speed, to run more slowly, or faster. After passing through the loop, the wire is straightened in a second straightening apparatus, and is pulled through a heating station.

This operation of pulling the wire through the second straightening apparatus, and through the heating station, is effected by means of the feed rollers which are attached to the metal-working machine, downstream of the heating station, and this feeding operation takes place, moreover, in an intermittent manner, at the operating frequency of the machine. It is evident, that the wire, which has been heated, by means of this operation, to a certain temperature, must still withstand a tensile load, this load deriving from the resistance which the second straightening apparatus exerts on the wire, as well as from the high acceleration of the wire material to be moved, since the feeding operation occupies only a small timespan within one revolution-cycle of the metal-working machine. From this, it follows that the wire had to possess a definite tensile strength, even in the heated condition.

The object of the present invention is consequently to obtain a material-feeding system which enables such coils of wire to be used, without any risk of plastically deforming the material, which has been heated to high temperatures, during the feeding phase, whether by stretching, as the result of an excessive tensile load, or by a rolling action, as a result of high contact pressures exerted by the feed rollers. In addition, the wire must have been rendered absolutely straight before being led into the heating station, and, during the processing operation in the metal-working machine, it should be pushed into the shearing-off device, in an intermittent manner, at the operating frequency of the machine.

This object is achieved, according to the invention, by means of the process and the appliance which are defined in the independent claims.

An illustrative embodiment of the invention is described in more detail by reference to the attached drawing, in which.

A shaft 2 is mounted, in a manner permitting rotation, in the machine body 1 of a hot metal-working machine. This shaft 2 is driven by means of a mechanism, which is not shown, but which is known, this mechanism rotating at the same speed as the crankshaft, that is to say, as the main drive of the machine. At the same time, the shaft 2 carries the ejector-cams, which are not shown, which control the ejector, which is fitted to the machine on the die side.

Figure 2:
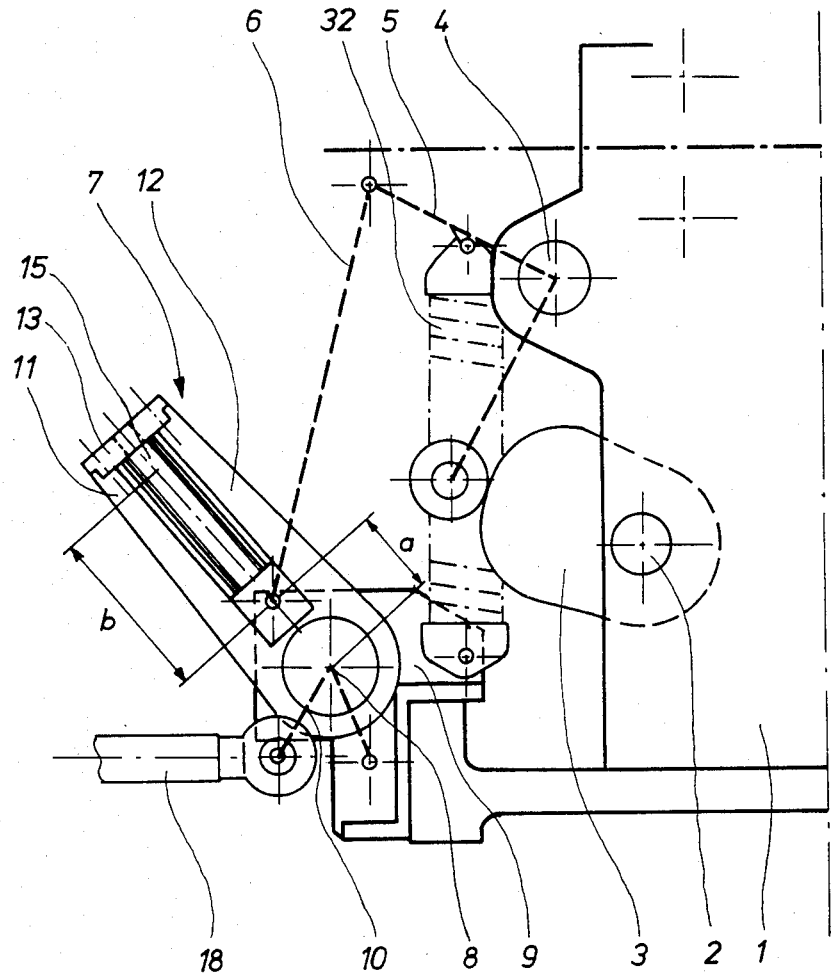
FIG. 2 shows the transmission elements of the material-feed drive system, at the side of the metal-working machine.

Two control cams are attached to the shaft 2. A first control cam 3 causes a bent lever 5, to execute a rocking movement, this bent lever being fitted on a shaft 4, which is mounted in the machine body 1, the roller **5*a* of this bent lever 5 running on the control cam 3, and the bent lever 5 being continuously pressed against the control cam 3 by means of a spring 32 (FIG. 2), this spring keeping the roller 5*a* in continuous contact with the control cam 3. The other end of the bent lever 5 is coupled to a double-plate connecting link 6, which is articulated to an adjusting lever 7. This adjusting lever 7 is fitted on a shaft 8, which is mounted, in a manner permitting rotation, in a support 9, which is rigidly attached to the machine body 1. In addition, the adjusting lever is also rigidly attached to a two-armed bent lever 10, which likewise pivots on the shaft 8**.

The adjusting lever 7 comprises two links, 11 and 12, which are connected by a web 13. The two links 11 and 12 form a slot, which is bounded, on both sides, by guide tracks, in which slot a joint-element 14, which forms the articulation between the connecting link 6 and the adjusting lever 7, can be displaced by a spindle 15, and can be locked in any desired position. The two-armed bent lever 10 transmits its rocking movement, on the one hand, to a connecting rod 16, which drives the feed rollers 17 (hot-feed) of the machine 1, via a gear unit with devices preventing backward movement and, on the other hand, to a transmission rod 18, which serves as the drive element for a cold-feeding apparatus 19. The bent lever 5 can also be designed with three arms, and be used to drive the ejector incorporated in a die.

Figure 3:
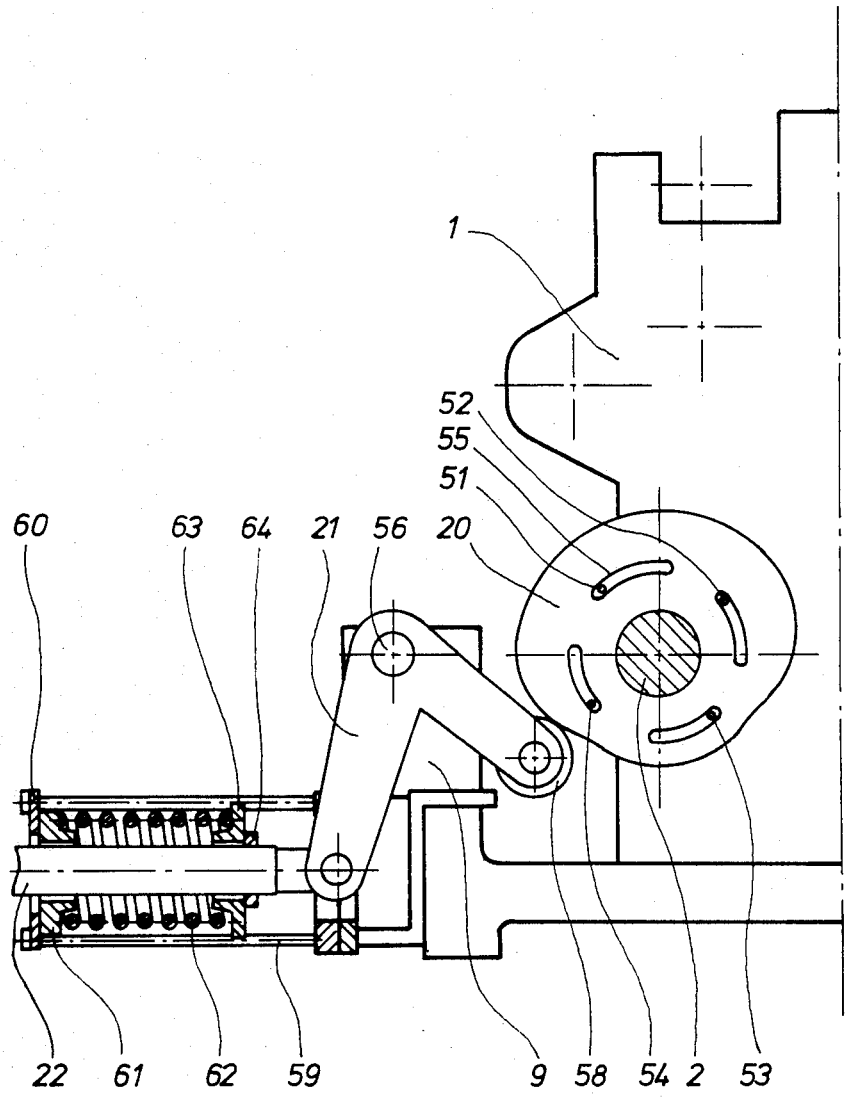
FIG. 3 shows the drive system, on the machine side, for the lifting mechanism of the cold-feeding fixture.
Figure 4:
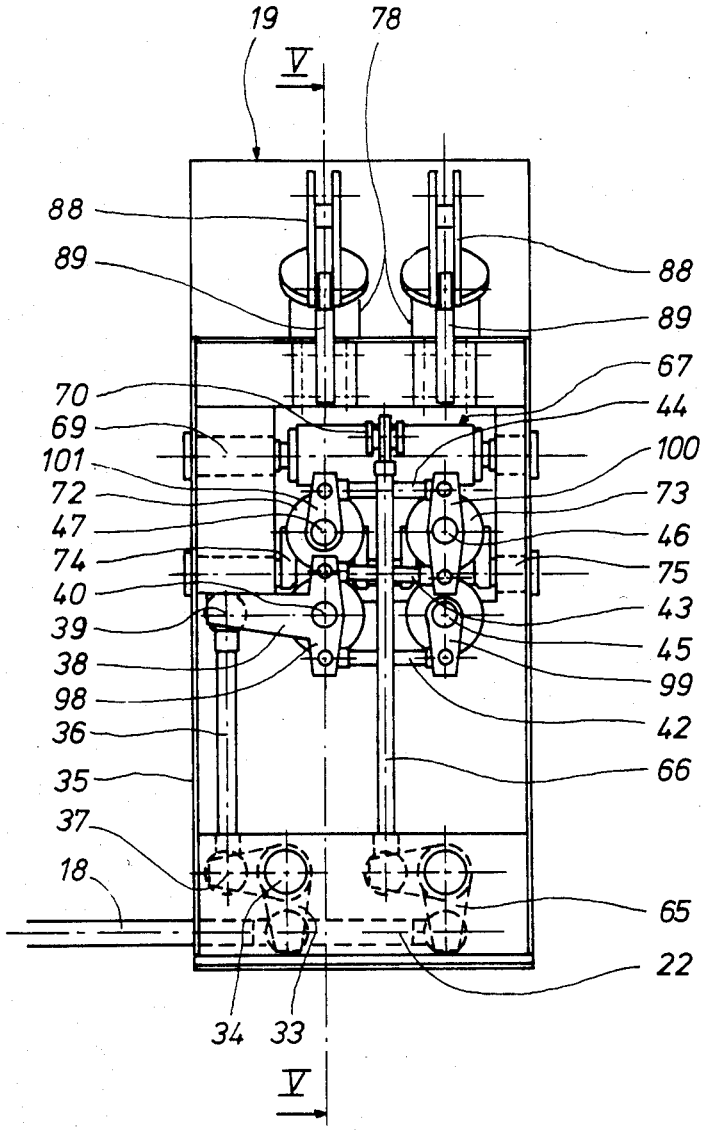
FIG. 4 shows a section through the cold-feeding fixture, along the line IV—IV (FIG. 5), from which the drive of the feed rollers can be seen.

A second control cam 20, which is visible in FIG. 3 and is referred to, in the text which follows, as the lifting cam, is located on the shaft 2, behind the control cam 3, this cam causing a bent lever 21 to execute a rocking movement, which is transmitted to the cold-feeding fixture 19 by means of a rod 22 (FIG. 4).

A known wire run-off and feeding unit 23 is located upstream of the cold-feeding fixture 19. The position of the coil 25 of wire is indicated, diagrammatically, on the loading mandrel 24 of this unit. A known straightening apparatus 26, with three lower, fixed straightening rollers 27, and two upper straightening rollers 28, which can be adjusted in the vertical direction, is attached to the wire run-off and feeding unit 23. The wire 29 is thus pulled from the wire run-off 23, passes through the straightening apparatus 26, is guided through the four feed rollers 30 of the cold-feeding fixture 19, passes through a known heating appliance 31, which is represented diagrammatically, is acquired by the feed rollers 17 of the machine 1, and is fed to the shearing-off device.

The adjusting lever 7 (FIG. 2) enables the feed stroke of the hot-feeding and cold-feeding fixtures to be adjusted simultaneously. By rotating a spindle 15, the joint-element 14 is displaced, this element forming the articulation-point between the connecting link 6 and the adjusting lever 7, and thereby lengthening or shortening the lever arm a, that is to say, altering the angular movement of the adjusting lever.

Infinitely-variable adjustment is possible within the section b. This adjusting section b can be equipped with a scale, whereupon the feed stroke can be read off in mm, for example, thus facilitating adjustment.

The rocking movement which is imparted, via the transmission rod 18, to the cold-feeding apparatus 19, is taken up by a double-plate bellcrank 33 (FIG. 4). This bellcrank 33 is attached to a shaft 34, which is mounted, in a manner permitting rotation, in the housing 35 of the cold-feeding apparatus 19. The rocking movement of the bellcrank 33 is transmitted to a rocker-arm 38, via a rod 36, which is articulated to the bellcrank 33 by means of the bearing 37, the connection of the rod 36 to the rocker-arm 38 being designed as an articulated joint 39.

Figure 5:
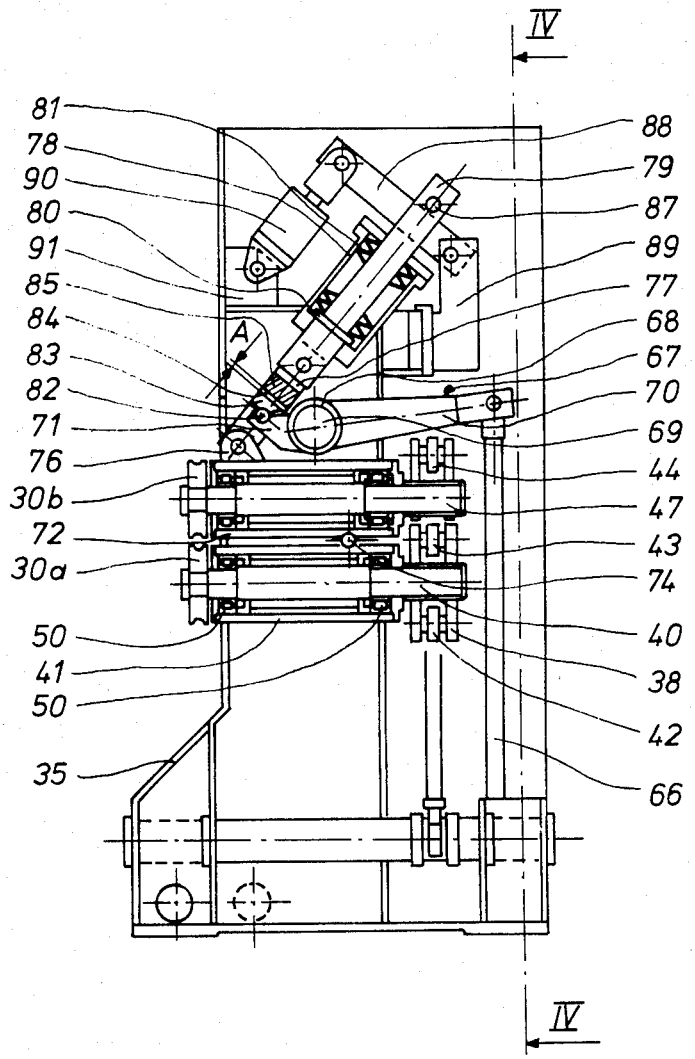
FIG. 5 shows a section through the cold-feeding fixture, along the line V—V (FIG. 4), from which the drive of the lifting device can be seen.

This rocker-arm 38 is manufactured integrally with a driving yoke 98, which is attached, in a rotationally rigid manner, to a shaft 40, which is mounted in a cylindrical sleeve 41, by means of roller bearings 50 (FIG. 5). One of the four cold-feeding rollers 30 is attached, in a rotationally rigid manner to the other end of the shaft 40. The rocking movement of the rocker-arm 38 is transmitted to the shafts 45, 46, 47 via a lever mechanism, with rods 42, 43, 44 and driving yokes 98, 99, 100, 101, these shafts being mounted in the same manner as the shaft 40 described previously. In each case, a cold-feeding roller 30 is likewise attached, in a rotationally rigid manner, to the other ends of the shafts 45, 46, 47. All the cold-feeding rollers 30 are thereby subjected to exactly the same rocking movement, the upper and lower rollers moving in opposite directions.

The drive of the lifting mechanism, serving to lift the upper feed rollers **30*b* of the cold-feeding fixture, can be seen from FIG. 3. The lifting cam 20 is mounted on the shaft 2, in a manner permitting rotation, being clamped, by means of four screws 51, 52, 53, 54, against a flange which is attached, in a rotationally rigid manner, to the shaft 2. In the region of the screws, the lifting cam 20 possesses four slots 55, which are arranged concentrically, that is to say, on a common circular arc, these slots permitting, after releasing the screws 51, 52, 53, 54, the lifting cam 20** to be adjusted, and reclamped, within a defined angular range.

The lifting cam 20 causes a bent lever 21 to execute a rocking movement, this bent lever 21 being fitted on a shaft 56, and being likewise mounted on the support 9, which is rigidly attached to the machine body 1. This rocking movement is imparted to the cold-feeding fixture via the rod 22. As a result of this movement, the two upper feed rollers **30*b* of the cold-feeding fixture are, towards the end of the feed stroke, lifted upwards from the wire, without their drive being in any way affected as a result. In order to prevent the roller 58 of the bent lever 21 from lifting from the lifting cam, four supporting rods 59 are let into the support 9, which carry, at the other end, a common flange 60, against which a spring plate 61 is pressed by the compression spring 62. The other end of the compression spring 62 is terminated by a flange 63, which is fitted inside the four supporting rods 59, and which presses against an annular flange 64 which is immovably attached to the rod 22. This arrangement continuously keeps the roller 58 in contact with the lifting cam 20**.

The movement of the drive mechanism, described above, is transmitted to the cold-feeding apparatus 19 via the rod 22, which is articulated to a bellcrank 65 (FIG. 4), which is, in its turn, connected, via an articulated rod 66, to the actual lifting lever 67.

As can be seen from FIG. 4, the drive mechanism of the cold-feeding fixture, described above, imparts a rotary movement to the feed rollers 30*a*, 30*b* on every stroke of the rod 36, this movement occurring in both rotation directions, it being possible to utilize only the rotation occurring in one direction for feeding the wire forward. All the feed rollers 30*a*, 30*b* must be lifted from the wire during the rotation in the opposite direction, as otherwise the wire would be moved backwards.

Figure 1:
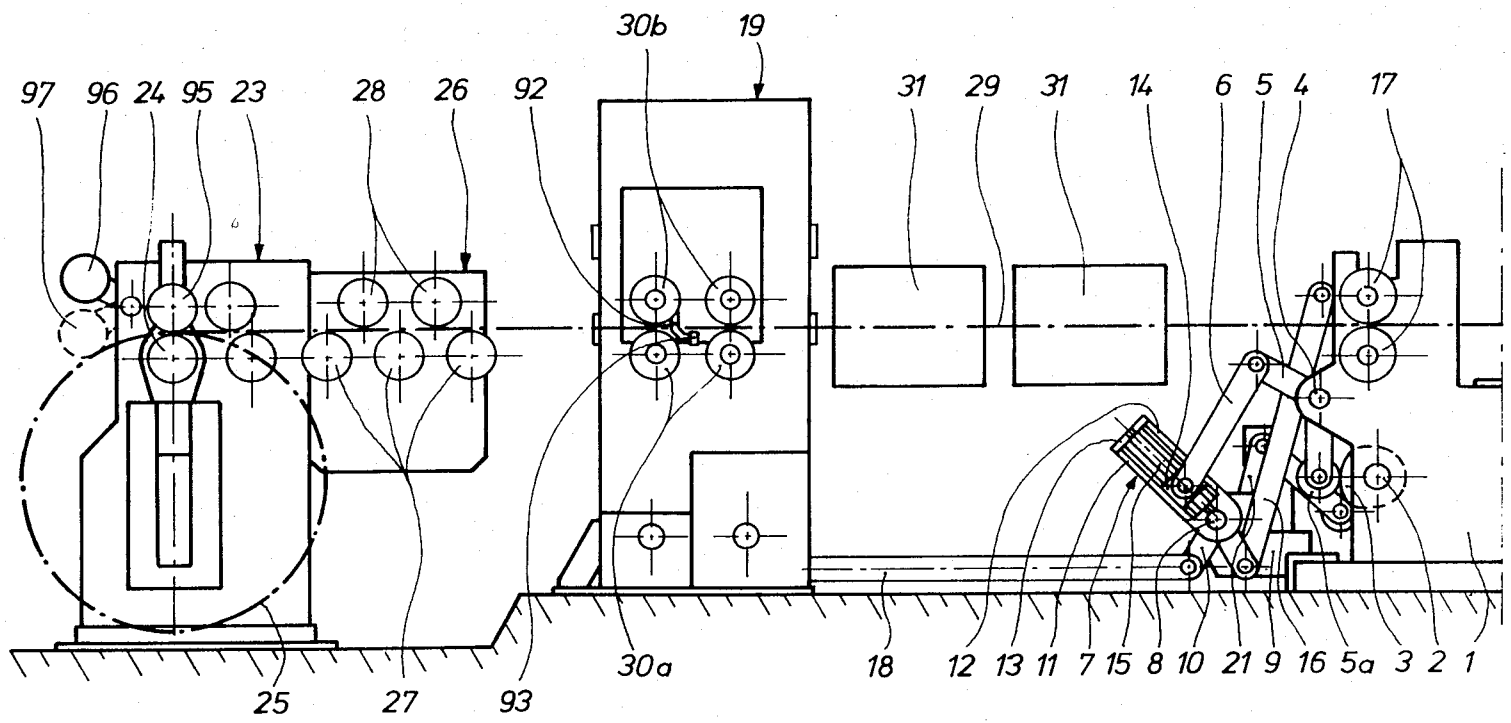
FIG. 1 shows a simplified representation of the arrangement of equipment upstream of the metal-working machine.

In the embodiment described, the upper feed rollers 30*b* are lifted during the reverse rotation. Since, however, in this phase the wire must also be lifted from the lower feed rollers 30*a*, which are likewise driven, a cranked lever 92 (FIG. 1) is bolted to one of the two bearing sleeves 72, the arm 93 of this lever coming to a position between the two lower feed rollers 30*a*, beneath the wire which is to be pulled in. During the lifting operation, this cranked lever 92 is raised with the upper feed rollers 30*b*, and thereby lifts the wire, by a certain amount, from the lower feed rollers 30*a*. This prevents the wire from catching in the lower feed rollers 30*a* while the feed rollers 30 are rotating backwards, and consequently prevents the wire from being moved backwards again.

The lifting lever 67 (FIG. 5) is formed by a cylindrical tube 68, which is mounted on a shaft 69, in a manner permitting rotation, this shaft being secured, in its turn, in the housing 35. A link 70 is attached to the tube 68, on the side facing away from the feed rollers 30, this link being articulated, at its end, to the rod 66. Two lugs 71 are attached to the side of the tube facing away from the link 70, these lugs actuating the lifting mechanism. The sleeves 72 and 73, in which the drive shafts 46, 47 for the upper feed rollers 30*b* are mounted, on roller bearings, are not located at fixed points in the housing 35 of the cold-feeding fixture, as are the bearing sleeves for the lower feed rollers 30*a*, but possess, at the rear end, a joint 74, which permits the sleeves 72 and 73 (FIG. 4) to execute an angular movement about the shaft 75, which is immovably fixed inside the housing 35 of the cold-feeding fixture. A web 76 is attached, in each case, to the front ends of the sleeves 72 and 73. An H-shaped link 77 is articulated, in each case, to this web 76, the other end of this link being articulated to a rod 79, which is guided in the spring bushing 78. This rod 79 is provided with a flange 80, which serves, on the one side, as a bearing surface for a stack 81 of springs, and, on the other side, as the lower position-limit for the upper feed rollers 30*b*. The stack 81 of springs is responsible for the pressure at which the upper feed rollers 30*b* contact the wire.

The lugs 71 of the lifting lever 67 project into the lower portion of the H-shaped link 77. A short shaft-piece 82 is attached to each of these lugs 71. A sliding insert 83 bears against this shaft piece 82. During the lifting operation, the rear of this sliding insert 83 presses against the sliding-bearing surface 84 of the transverse web 85 of the H-shaped link 77. When the feed rollers 30 are in the pressure-contact condition, a gap A exists between the sliding piece 83 and the sliding-bearing surface 84, thus guaranteeing that, in the pressure-contact condition, the full force of the stack 81 of springs always acts on the wire 29 which is to be fed in.

In each case, the rod 79 projects by a certain amount from the rear side of the spring bush 78, and posseses, in each case, a transverse bolt 87. This transverse bolt 87 serves as the fulcrum of a double lever 88, which, at one end, is mounted, in a manner permitting rotation, on a bearing pedestal 89, which is immovably fitted inside the housing 35 and, at the other end, is articulated to a hydraulic cylinder. This hydraulic cylinder 90 is, in its turn, connected, in a manner permitting rotation, to a bearing pedestal 91, which is immovably fitted inside the housing 35. These cylinders 90 enable the upper feed rollers 30*b* to be lifted, irrespective of the position of the lifting lever 67, in that the gap A between the sliding insert 83 and the sliding-bearing surface 84 becomes larger, in a manner such that it is never completely closed, even when the lifting lever 67 is located in its upper (lifted) position. This arrangement, which can be manually operated at any desired moment, is intended to permit the upper feed rollers 30*b* to be lifted, in the event of a breakdown, or when a new coil of wire is being placed in position.

Mode of operation: the coil 25 of wire is placed on the mandrel 24 of the wire run-off and feeding unit 23. The contact roller 95 of the wire run-off and feeding unit 23 is in the raised state. The beginning of the coil 25 of wire can now be inserted between the mandrel 24 and the contact roller 95. The metal-working machine is started, but in the declutched state. The upper hot-feeding roller 17 is lifted. The upper cold-feeding rollers 30*b* are in the raised state, brought about by the two hydraulic cylinders 90.

The contact roller 95 is now lowered, and the mandrel 24 is driven, rotating at a speed which can be adjusted, and corresponds to the average speed at which the wire is fed forward, this speed being determined by the feed rollers.

The wire 29 now runs through the straightening apparatus 26, after which the feed drive of the wire run-off unit 23 can be stopped in order to process the beginning of the wire. The feed is then restarted. The straightened wire 29, which is running forward, is led into the cold-feeding apparatus 19, the upper feed rollers 30*b* of which are, of course, in the raised state. The wire 29 then runs through the heating station 31, is heated to the forging temperature and finally arrives in front of the hot-feeding rollers 17. The metal-working machine is now clutched-in, that is to say, the hot-feeding rollers 17 (upper roller still lifted) and the cold-feeding rollers 30 (upper rollers 30*b* still lifted) rotate in synchronization with the machine. The hot-feeding rollers are lowered when the beginning of the wire 29 has reached them. At the same time, the cold-feeding rollers 30*b* are automatically lowered, while the contact roller 95 of the wire feeding unit 23 is, at the same time, automatically lifted from the mandrel 24. The wire 29 is now fed, in an intermittent manner to the machine, while the mandrel 24 of the wire run-off unit 23 continues to rotate at the mean speed which has been set. The first section of rod which is sheared off is still discarded, after which the machine can produce forged components.

In this process, it is important that the feed rollers 30*a*, 30*b* pull the wire, from the coil of wire, using the full contact pressure, but are inoperative during the last phase of each feed stroke. In this last phase, the hot wire continues to be fed forward solely by the hot-feeding rollers, the contact pressures of these rollers, and/or their drive torques being so low that there is no possibility of the hot wire being deformed.

The two material feed-systems, driven by the metal-working machine, are synchronously coupled to each other. This arrangement enables the wire to be heated to a maximum temperature, which is most favorable for the working operation, since the heated piece of wire is subjected to virtually no stresses. In addition, the drive of the cold-feeding fixture is very simple, is matched to the operating frequency of the machine, and requires no additional control elements and no additional drive units, which would have to be monitored by the control elements. In addition, the space requirement is very small.

Before the end of the wire has left the mandrel 24, a new coil of wire is placed on the mandrel 24, it being possible to switch off the rotary movement of the mandrel, since the remaining weight of the previous wire is only very low. It is now possible, already, to process the beginning of the wire from the new coil of wire. When the old wire has left the mandrel 24, the beginning of the new wire is threaded in, between the lifted contact roller 95 and the stationary mandrel 24. The contact roller 95 is now lowered, while, at the same time, the mandrel 24 is set into motion, at a mean speed, while the upper rollers 30*b* of the cold-feeding fixture 19 are simultaneously lifted. By increasing the speed at which the mandrel 24 rotates, the beginning of the new wire catches up with the end of the old wire, this occurring before the heating station 31 is reached. As soon as the beginning of the new wire has caught up with the end of the old wire, the rotation speed of the mandrel 24 is reset to a mean speed. Immediately before the hot-feeding rollers 17 are reached, the cold-feeding rollers 30*b* are lowered, while the contact roller 95 is simultaneously lifted. The operating cycle continues.

If, now, a fault occurs, and both the machine and the wire run-off unit 23 are stopped, the wire can be pulled out of the machine. To do this, the rewinding roller 96 is brought into the position 97, shown by a broken line, and is mechanically locked. The rewinding button is then pressed, causing the upper hot-feeding roller 17 to be lifted, the two upper cold-feeding rollers 30*b* to be lifted, the contact roller 95 to be lowered, and the mandrel 24 to start to rotate, and, moreover, in the reverse direction. The wire is rewound onto the coil of wire by means of the rewinding roller 97. It can be run back completely, or only partially.

The lifting cam 20 is adjustable. The point in time "start lifting" can be set by twisting the cam 20 relative to the shaft 2, this also enabling the ratio of the cold-feeding stroke to the hot-feeding stroke to be set. By appropriately choosing the position of the cam 20, the effective proportion of the stroke due to the cold-feeding fixture always becomes somewhat smaller than that due to the hot-feeding fixture; the effective stroke of the cold-feeding fixture should definitely be completed by the time the front end of the wire strikes the stop, and, in practice, always a little earlier. Due to the light contact pressure of the hot-feeding rollers, these rollers then slide on the hot wire during the last phase of each individual stroke.

Since, due to the thermal expansion of the wire, the hot-feeding and cold-feeding fixtures cannot run precisely identically, the joint 39 (FIG. 4) is provided with an eccentric. This enables the distance between the joint-point 39 and the shaft 40 to be varied, thus enabling the thermal expansion of the rod to be compensated. This eccentric can be provided with a scale, which can be adjusted in accordance with the calibration, thereby facilitating adjustment of the eccentric.

The process which has been described, and the associated appliance can be employed, within the scope of the concept of the invention, both for hot-working and for the process which is designated, in metal-working technology, as "semi-cold working".

The illustrative embodiment which has been described can be modified in many respects, by a person skilled in the art, within the scope of the concept of the invention; it would thus be possible, for example, to render the feed rollers 30*a*, 30*b*, of the cold-feeding fixture inoperative by means of a clutch, which switches them to idle during the last phase of the stroke, rather than by lifting them.

We claim:

1. A device for feeding material in the form of a coil of wire from a fixture for receiving and rotating said coil of wire through a straightening apparatus and a heating station to a hot and semi-cold metal-working machine in an intermittent manner comprising a cold feeding fixture located upstream of said heating station with one or more pairs of feed rollers, which act on the cold wire with its full contact pressure over a major portion of each individual stroke to pull said wire from said coil and through said straightening apparatus, and with an at least reduced contact pressure over the remaining portion of said stroke, a hot-feeding fixture located downstream of said heating station with at least one pair of feed rollers, which act on the hot wire over said remaining portion of each stroke with a predetermined low contact pressure to feed and urge said hot wire against a stop of said metal-working machine and adjustable link means for driving both feeding fixtures in functional synchronism with said metal-working machine.

2. The device as set forth in claim 1, wherein said link means for driving both feeding fixtures comprise a common control element in the form of a cam disc, which is rotatable in synchronization with the metal-working machine, and an adjusting mechanism for simultaneously regulating the feed stroke of both feeding fixtures, this adjusting mechanism being provided with an adjusting element, which is located between a connecting link and a bent lever, whereby the one end portion of said connecting link being displaceably mounted, by means of a joint, on this adjusting element, and being adjustable by means of a spindle, and the other end portion of said connecting link being pivotly coupled to a bent lever, which is connected to said adjusting element in a rotationally rigid manner, is at its both free ends pivotly connected to transmission links for the two feeding fixtures.

3. The device as set forth in claim 2 wherein a gear unit with means preventing backward movement of said hot wire being provided between the transmission link and the hot-feeding fixture.

4. The device as set forth in claim 2, wherein the feed rollers of the cold-feeding fixture are driven by the transmission link via a lever mechanism, which drives the upper and lower feed rollers, of each pair of feed rollers, in opposite direction of rotation, whereby each feed roller being attached, in a rotationally rigid manner, to each one driving yoke, all of them being connected one to another by connecting rods of said lever mechanism in such a manner that a rocking movement of the first driving yoke which is connected with said transmission link, is transmitted to the other driving yokes and hence to the remaining feed rollers.

5. The device as set forth in claim 4, wherein the lever mechanism between the transmission link and said connecting rods is provided with an adjusting means to compensate the length-difference occurring in the region of the hot-feeding fixture as a result of thermal expansion of the wire.

6. The device as set forth in claim 5, wherein between the transmission link and said connecting rods an additional link is provided, whereby the point, at which this link acts on a projecting arm of said first driving yoke, comprising said adjusting means which is adjustable by means of an eccentric.

7. The device as set forth in claim 1, wherein said cold-feeding fixture is provided, in addition to a feed-roller drive, with a lift-off device, which in the last portion of each feed stroke, lifts off one roller of each pair of feed rollers from the wire.

8. The device as set forth in claim 1, wherein one feed roller of each pair of feed rollers of the cold-feeding fixture is pivotly mounted at a joint, via a sleeve, by means of a lifting lever for lifting said feed roller off a wire.

9. The device as set forth in claim 1, wherein the pivotably mounted sleeves of the feed rollers, are subjected to the influence of a spring which determines the contact pressure of the pairs of feed rollers, and said lifting lever acts, via a sliding member, on a lever, which is articulated to the respective sleeve.

10. The device as set forth in claim 1, wherein a lift-off arrangement is provided, which acts on the pivotably mounted sleeves, of those feed rollers which can be lifted off from the wire, especially in the event of a breakdown, as well as in order to introduce a new coil of wire.

11. The device as set forth in claim 10, wherein a lifting dog, extending beneath the path of the wire movement, is attached to one of the upper liftable feed rollers, this lifting dog lifting the wire clear of the lower feed rollers when the upper feed rollers are lifted off.

* * * * *